US010480311B2

(12) United States Patent
Stolyarov et al.

(10) Patent No.: US 10,480,311 B2
(45) Date of Patent: Nov. 19, 2019

(54) DOWNHOLE INTERVENTION OPERATION OPTIMIZATION

(71) Applicants: Sergey Stolyarov, Tomball, TX (US); Sergey Kotov, Houston, TX (US); Alex Bruns, Conroe, TX (US); David Gadzhimirzaev, Houston, TX (US); Frank Walles, The Woodlands, TX (US)

(72) Inventors: Sergey Stolyarov, Tomball, TX (US); Sergey Kotov, Houston, TX (US); Alex Bruns, Conroe, TX (US); David Gadzhimirzaev, Houston, TX (US); Frank Walles, The Woodlands, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 83 days.

(21) Appl. No.: 15/638,792

(22) Filed: Jun. 30, 2017

(65) Prior Publication Data

US 2019/0003298 A1 Jan. 3, 2019

(51) Int. Cl.
*G01V 3/00* (2006.01)
*E21B 47/09* (2012.01)
(Continued)

(52) U.S. Cl.
CPC ..... *E21B 47/091* (2013.01); *E21B 43/14* (2013.01); *E21B 44/005* (2013.01); *E21B 47/12* (2013.01)

(58) Field of Classification Search
CPC ... G01V 3/28; G01V 3/38; G01V 3/18; G01V 3/20; G01V 3/22; G01V 3/24; G01V 3/26;
(Continued)

(56) References Cited

U.S. PATENT DOCUMENTS 619,318 A 2/1899 Kubica
4,635,735 A * 1/1987 Crownover ..... E21B 21/067 175/42
(Continued)

FOREIGN PATENT DOCUMENTS

WO 2012087864 A1 6/2012
WO 2016025672 A1 2/2016

OTHER PUBLICATIONS

Chang, Frank "Matrix Stimulation", SPE, Petroleum Engineering, Jun. 1, 2017; 5 pages.
(Continued)

*Primary Examiner* — Thang X Le
(74) *Attorney, Agent, or Firm* — Cantor Colburn LLP

(57) ABSTRACT

Methods and systems for generating intervention programs for a downhole formation including collecting mud-logging data during a drilling operation, wherein the drilling operation forms a borehole through the formation, generating zone characterization of one or more zones along the borehole based on the collected mud-logging data, defining targeted zones of the one or more zones along the borehole, generating a treatment characterization for each targeted zone based on the collected mud-logging data, and generating an intervention treatment design based on the targeted zones and associated treatment characterizations.

20 Claims, 4 Drawing Sheets

(51) Int. Cl.
*E21B 44/00* (2006.01)
*E21B 43/14* (2006.01)
*E21B 47/12* (2012.01)

(58) Field of Classification Search
CPC . G01V 3/30; G01V 3/10; G01V 3/265; G01V 3/02; G01V 3/04; G01V 3/06; G01V 3/104; G01N 27/223; G01N 33/246; G01R 27/18; G01R 27/20; E21B 47/91; E21B 43/14; E21B 44/005
See application file for complete search history.

(56) References Cited

U.S. PATENT DOCUMENTS

| | | | | |
|---|---|---|---|---|
| 5,291,950 | A | 3/1994 | Grebennikov | |
| 6,668,922 | B2 | 12/2003 | Ziauddin et al. | |
| 7,971,658 | B2 | 7/2011 | Buckman | |
| 8,170,799 | B2 | 5/2012 | Dvorkin et al. | |
| 8,967,249 | B2 | 3/2015 | Akkurt et al. | |
| 9,004,195 | B2 | 4/2015 | Regener et al. | |
| 9,580,642 | B2 * | 2/2017 | Brannon | E21B 33/134 |
| 9,822,626 | B2 * | 11/2017 | Dumoit | E21B 43/267 |
| 2011/0139464 | A1 * | 6/2011 | Henderson | E21B 21/01 166/370 |
| 2013/0140031 | A1 | 6/2013 | Cohen et al. | |
| 2013/0269933 | A1 | 10/2013 | Pomerantz et al. | |
| 2014/0182841 | A1 | 7/2014 | Lecerf et al. | |
| 2014/0222392 | A1 | 8/2014 | Johnson et al. | |
| 2014/0251601 | A1 | 9/2014 | Wang et al. | |
| 2015/0015250 | A1 | 1/2015 | Gzara et al. | |
| 2017/0075007 | A1 * | 3/2017 | Walters | G01V 1/306 |
| 2018/0202263 | A1 * | 7/2018 | Prasad | E21B 43/26 |
| 2018/0313198 | A1 * | 11/2018 | Aguilera | E21B 43/26 |
| 2018/0355707 | A1 * | 12/2018 | Rodriguez Herrera | E21B 43/26 |

OTHER PUBLICATIONS

Cramer, et al. "Rose Run Stimulation: A Case History of Problem Identification, Research, Planning, Implementation, and Evaluation", SPE East. Reg. Conf. & Exhibition (Charleston, WV, 11/8-10/94); 12 pages.

Druyff, et al. "Petrophysical Properties Determined from Analysis of Drill Cuttings", Rocky Mountain Association of Geologists, Producing Low Contrast, Low Resistivity Reservoirs Guidebook (1996); 12 pages.

Egermann, et al. "A Fast and Direct Method of Permeability Measurement on Drill Cuttings", Article in SPE Reservoir Evaluation & Engineering, Sep. 2002; 13 pages.

"Formation evaluation for acidizing", PetroWiki [Retrieved from: http://petrowiki.org/index.php?title=Formation_evaluation_for acidizing &printable=yes], Jul. 1, 2015 (4 pages).

Portier, et al. "Modelling acid-rock interactions and mineral dissolution during RMA stimulation test performed at the Soultz-sous-Forêts EGS site, France", Published in Proceedings World Geothermal Congress, session 31, 3127, 1-8, 2010; 8 pages.

Shaw, et al. "Reservoir Quality Evaluation for Stimulation Design in Low Permeability Gas Development", Petroleum Society of Canada, Canadian International Petroleum Conference, Jun. 8-10, 2004, Calgary, Alberta; 13 pages.

Siliwinski, et al. "A New Quantitative Method for Analysis of Drill Cuttings and Core for Geologic, Diagenetic and Reservoir Evaluation", Frontiers + Innovation—CSPG CSEG CWLS Convention, Calgaray, Alberta, Canada (2009); 4 pages.

International Search Report, International Application No. PCT/US2018/039469, dated Oct. 29, 2018; International Search Report 5 pages.

International Written Opinion, International Application No. PCT/US2018/039469, dated Oct. 29, 2018; Written Opinion 7 pages.

* cited by examiner

DOWNHOLE INTERVENTION OPERATION OPTIMIZATION

BACKGROUND

1. Field of the Invention

The present invention generally relates to exploration and operations made downhole in a borehole.

2. Description of the Related Art

Boreholes are drilled deep into the earth for many applications such as carbon dioxide sequestration, geothermal production, and hydrocarbon exploration and production. In all of the applications, the boreholes are drilled such that they pass through or allow access to a material (e.g., a gas or fluid) contained in a formation located below the earth's surface. Different types of tools and instruments may be disposed in the boreholes to perform various tasks and measurements.

In more detail, boreholes or boreholes for producing hydrocarbons (such as oil and gas) are drilled using a drill string that includes a tubing made up of, for example, jointed tubulars or continuous coiled tubing that has a drilling assembly, also referred to as the bottom hole assembly (BHA), attached to its bottom end. The BHA typically includes a number of sensors, formation evaluation tools, and directional drilling tools. A drill bit attached to the BHA is rotated with a drilling motor in the BHA and/or by rotating the drill string to drill the borehole. While drilling, the sensors can determine several attributes about the motion and orientation of the BHA that can used, for example, to determine how the drill string will progress. Further, such information can be used to detect or prevent operation of the drill string in conditions that are less than favorable.

In the process of extracting hydrocarbons, e.g., petroleum, from beneath the surface of the earth, wells are drilled and downhole operations can be performed to aid in extraction of such hydrocarbons. For example, intervention operations, such as acid treatments, fracturing operations, etc. can be employed to treat or otherwise effect downhole formations and reservoirs therein. Improving such operations may be beneficial.

SUMMARY

Disclosed herein are systems and methods for generating intervention programs for a downhole formation including collecting mud-logging data during a drilling operation, wherein the drilling operation forms a borehole through the formation, generating zone characterization of one or more zones along the borehole based on the collected mud-logging data, defining targeted zones of the one or more zones along the borehole, generating a treatment characterization for each targeted zone based on the collected mud-logging data, and generating an intervention treatment design based on the targeted zones and associated treatment characterizations.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

DETAILED DESCRIPTION

Figure 1:
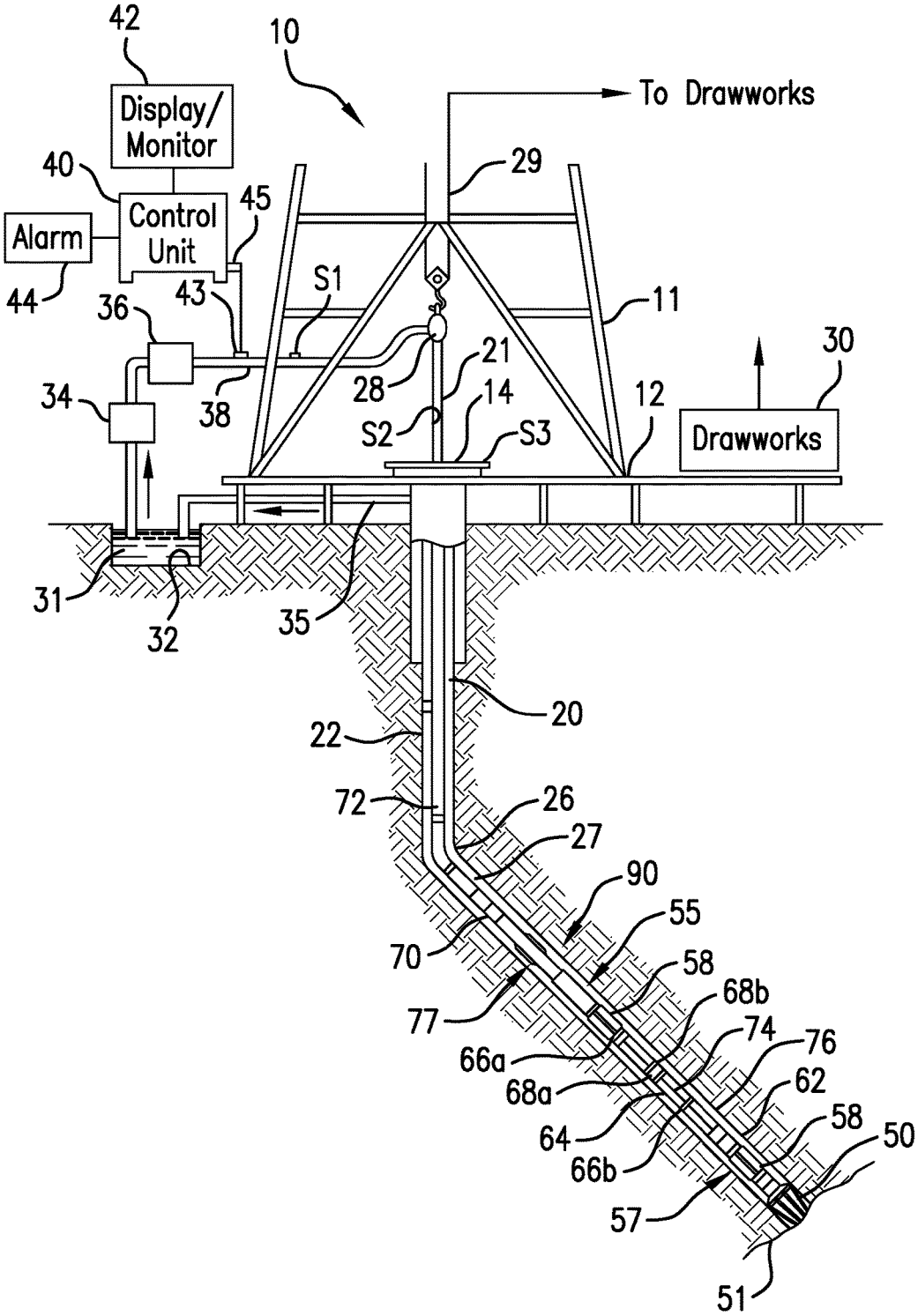
FIG. 1 is an example of a system for performing downhole operations that can employ embodiments of the present disclosure.

FIG. 1 shows a schematic diagram of a system for performing downhole operations. As shown, the system is a drilling system 10 that includes a drill string 20 having a drilling assembly 90, also referred to as a bottomhole assembly (BHA), conveyed in a borehole 26 penetrating an earth formation 60. The drilling system 10 includes a conventional derrick 11 erected on a floor 12 that supports a rotary table 14 that is rotated by a prime mover, such as an electric motor (not shown), at a desired rotational speed. The drill string 20 includes a drilling tubular 22, such as a drill pipe, extending downward from the rotary table 14 into the borehole 26. A disintegrating tool 50, such as a drill bit attached to the end of the BHA 90, disintegrates the geological formations when it is rotated to drill the borehole 26. The drill string 20 is coupled to a drawworks 30 via a kelly joint 21, swivel 28 and line 29 through a pulley 23. During the drilling operations, the drawworks 30 is operated to control the weight on bit, which affects the rate of penetration. The operation of the drawworks 30 is well known in the art and is thus not described in detail herein.

During drilling operations a suitable drilling fluid 31 (also referred to as the "mud") from a source or mud pit 32 is circulated under pressure through the drill string 20 by a mud pump 34. The drilling fluid 31 passes into the drill string 20 via a desurger 36, fluid line 38 and the kelly joint 21. The drilling fluid 31 is discharged at the borehole bottom 51 through an opening in the disintegrating tool 50. The drilling fluid 31 circulates uphole through the annular space 27 between the drill string 20 and the borehole 26 and returns to the mud pit 32 via a return line 35. A sensor S1 in the line 38 provides information about the fluid flow rate. A surface torque sensor S2 and a sensor S3 associated with the drill string 20 respectively provide information about the torque and the rotational speed of the drill string. Additionally, one or more sensors (not shown) associated with line 29 are used to provide the hook load of the drill string 20 and about other desired parameters relating to the drilling of the borehole 26. The system may further include one or more downhole sensors 70 located on the drill string 20 and/or the BHA 90.

In some applications the disintegrating tool 50 is rotated by only rotating the drill pipe 22. However, in other applications, a drilling motor 55 (mud motor) disposed in the drilling assembly 90 is used to rotate the disintegrating tool 50 and/or to superimpose or supplement the rotation of the drill string 20. In either case, the rate of penetration (ROP) of the disintegrating tool 50 into the borehole 26 for a given formation and a drilling assembly largely depends upon the weight on bit and the drill bit rotational speed. In one aspect of the embodiment of FIG. 1, the mud motor 55 is coupled to the disintegrating tool 50 via a drive shaft (not shown) disposed in a bearing assembly 57. The mud motor 55 rotates the disintegrating tool 50 when the drilling fluid 31 passes through the mud motor 55 under pressure. The bearing assembly 57 supports the radial and axial forces of the disintegrating tool 50, the downthrust of the drilling motor and the reactive upward loading from the applied weight on bit. Stabilizers 58 coupled to the bearing assembly 57 and other suitable locations act as centralizers for the lowermost portion of the mud motor assembly and other such suitable locations.

A surface control unit 40 receives signals from the downhole sensors 70 and devices via a sensor 43 placed in the fluid line 38 as well as from sensors S1, S2, S3, hook load sensors and any other sensors used in the system and processes such signals according to programmed instructions provided to the surface control unit 40. The surface control unit 40 displays desired drilling parameters and other information on a display/monitor 42 for use by an operator at the rig site to control the drilling operations. The surface control unit 40 contains a computer, memory for storing data, computer programs, models and algorithms accessible to a processor in the computer, a recorder, such as tape unit, memory unit, etc. for recording data and other peripherals. The surface control unit 40 also may include simulation models for use by the computer to processes data according to programmed instructions. The control unit responds to user commands entered through a suitable device, such as a keyboard. The control unit 40 is adapted to activate alarms 44 when certain unsafe or undesirable operating conditions occur.

The drilling assembly 90 also contains other sensors and devices or tools for providing a variety of measurements relating to the formation surrounding the borehole and for drilling the borehole 26 along a desired path. Such devices may include a device for measuring the formation resistivity near and/or in front of the drill bit, a gamma ray device for measuring the formation gamma ray intensity and devices for determining the inclination, azimuth and position of the drill string. A formation resistivity tool 64, made according an embodiment described herein may be coupled at any suitable location, including above a lower kick-off subassembly 62, for estimating or determining the resistivity of the formation near or in front of the disintegrating tool 50 or at other suitable locations. An inclinometer 74 and a gamma ray device 76 may be suitably placed for respectively determining the inclination of the BHA and the formation gamma ray intensity. Any suitable inclinometer and gamma ray device may be utilized. In addition, an azimuth device (not shown), such as a magnetometer or a gyroscopic device, may be utilized to determine the drill string azimuth. Such devices are known in the art and therefore are not described in detail herein. In the above-described exemplary configuration, the mud motor 55 transfers power to the disintegrating tool 50 via a hollow shaft that also enables the drilling fluid to pass from the mud motor 55 to the disintegrating tool 50. In an alternative embodiment of the drill string 20, the mud motor 55 may be coupled below the resistivity measuring device 64 or at any other suitable place.

Still referring to FIG. 1, other logging-while-drilling (LWD) devices (generally denoted herein by numeral 77), such as devices for measuring formation porosity, permeability, density, rock properties, fluid properties, etc. may be placed at suitable locations in the drilling assembly 90 for providing information useful for evaluating the subsurface formations along borehole 26. Such devices may include, but are not limited to, acoustic tools, nuclear tools, nuclear magnetic resonance tools and formation testing and sampling tools.

The above-noted devices transmit data to a downhole telemetry system 72, which in turn transmits the received data uphole to the surface control unit 40. The downhole telemetry system 72 also receives signals and data from the surface control unit 40 and transmits such received signals and data to the appropriate downhole devices. In one aspect, a mud pulse telemetry system may be used to communicate data between the downhole sensors 70 and devices and the surface equipment during drilling operations. A transducer 43 placed in the mud supply line 38 detects the mud pulses responsive to the data transmitted by the downhole telemetry 72. Transducer 43 generates electrical signals in response to the mud pressure variations and transmits such signals via a conductor 45 to the surface control unit 40. In other aspects, any other suitable telemetry system may be used for two-way data communication between the surface and the BHA 90, including but not limited to, an acoustic telemetry system, an electro-magnetic telemetry system, a wireless telemetry system that may utilize repeaters in the drill string or the borehole and a wired pipe. The wired pipe may be made up by joining drill pipe sections, wherein each pipe section includes a data communication link that runs along the pipe. The data connection between the pipe sections may be made by any suitable method, including but not limited to, hard electrical or optical connections, induction, capacitive or resonant coupling methods. In case a coiled-tubing is used as the drill pipe 22, the data communication link may be run along a side of the coiled-tubing.

The drilling system described thus far relates to those drilling systems that utilize a drill pipe to conveying the drilling assembly 90 into the borehole 26, wherein the weight on bit is controlled from the surface, typically by controlling the operation of the drawworks. However, a large number of the current drilling systems, especially for drilling highly deviated and horizontal boreholes, utilize coiled-tubing for conveying the drilling assembly downhole. In such application a thruster is sometimes deployed in the drill string to provide the desired force on the drill bit. Also, when coiled-tubing is utilized, the tubing is not rotated by a rotary table but instead it is injected into the borehole by a suitable injector while the downhole motor, such as mud motor 55, rotates the disintegrating tool 50. For offshore drilling, an offshore rig or a vessel is used to support the drilling equipment, including the drill string.

Still referring to FIG. 1, a resistivity tool 64 may be provided that includes, for example, a plurality of antennas including, for example, transmitters 66*a* or 66*b* or and receivers 68*a* or 68*b*. Resistivity can be one formation property that is of interest in making drilling decisions. Those of skill in the art will appreciate that other formation property tools can be employed with or in place of the resistivity tool 64.

Liner drilling can be one configuration or operation used for providing a disintegrating device becomes more and more attractive in the oil and gas industry as it has several advantages compared to conventional drilling. One example of such configuration is shown and described in commonly owned U.S. Pat. No. 9,004,195, entitled "Apparatus and Method for Drilling a Borehole, Setting a Liner and Cementing the Borehole During a Single Trip," which is incorporated herein by reference in its entirety. Importantly, despite a relatively low rate of penetration, the time of getting the liner to target is reduced because the liner is run in-hole while drilling the borehole simultaneously. This may be beneficial in swelling formations where a contraction of the drilled well can hinder an installation of the liner later on. Furthermore, drilling with liner in depleted and unstable reservoirs minimizes the risk that the pipe or drill string will get stuck due to hole collapse.

Although FIG. 1 is shown and described with respect to a drilling operation, those of skill in the art will appreciate that similar configurations, albeit with different components, can be used for performing different downhole operations. For example, wireline, coiled tubing, and/or other configurations can be used as known in the art. Further, production configurations can be employed for extracting and/or injecting materials from/into earth formations. Thus, the present disclosure is not to be limited to drilling operations but can be employed for any appropriate or desired downhole operation(s).

Figure 2:
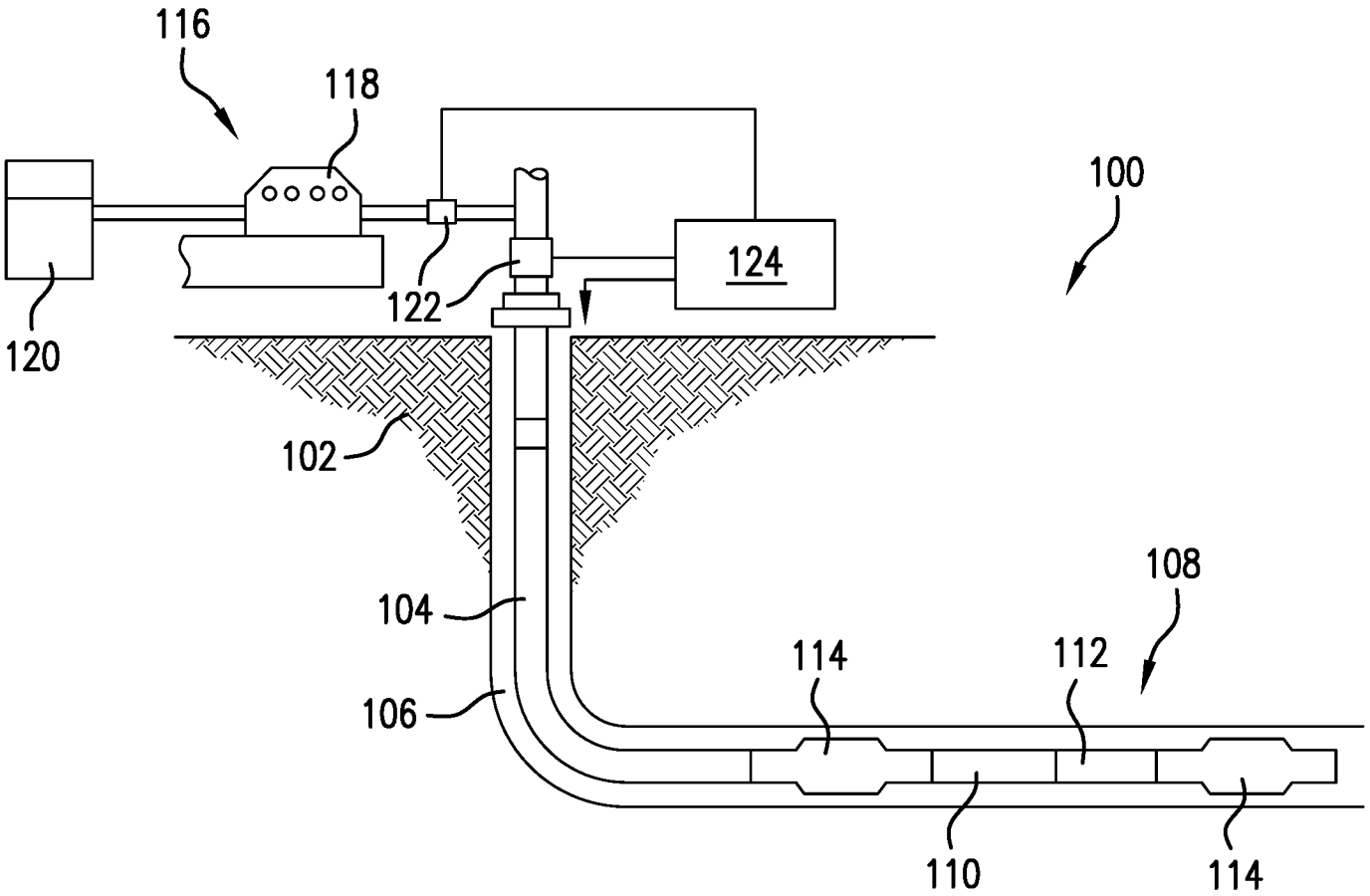
FIG. 2 depicts a system for formation stimulation and hydrocarbon production that can incorporate embodiments of the present disclosure.

Turning now to FIG. 2, a schematic illustration of an embodiment of a system 100 for hydrocarbon production and/or evaluation of an earth formation 102 that can employ embodiments of the present disclosure is shown. The system 100 includes a borehole string 104 disposed within a borehole 106. The string 104, in one embodiment, includes a plurality of string segments or, in other embodiments, is a continuous conduit such as a coiled tube. As described herein, "string" refers to any structure or carrier suitable for lowering a tool or other component through a borehole or connecting a drill bit to the surface, and is not limited to the structure and configuration described herein. The term "carrier" as used herein means any device, device component, combination of devices, media, and/or member that may be used to convey, house, support, or otherwise facilitate the use of another device, device component, combination of devices, media, and/or member. Example, non-limiting carriers include, but are not limited to, casing pipes, wirelines, wireline sondes, slickline sondes, drop shots, downhole subs, bottomhole assemblies, and drill strings.

In one embodiment, the system 100 is configured as a hydraulic stimulation system. As described herein, "stimulation" may include any injection of a fluid into a formation. A fluid may be any flowable substance such as a liquid or a gas, or a flowable solid such as sand. In such embodiment, the string 104 includes a downhole assembly 108 that includes one or more tools or components to facilitate stimulation of the formation 102. For example, the string 104 includes a fluid assembly 110, such as a fracture or "frac" sleeve device or an electrical submersible pumping system, and a perforation assembly 112. Examples of the perforation assembly 112 include shaped charges, torches, projectiles, and other devices for perforating a borehole wall and/or casing. The string 104 may also include additional components, such as one or more isolation or packer subs 114.

One or more of the downhole assembly 108, the fracturing assembly 110, the perforation assembly 112, and/or the packer subs 114 may include suitable electronics or processors configured to communicate with a surface processing unit and/or control the respective tool or assembly. A surface system 116 can be provided to extract material (e.g., fluids) from the formation 102 or to inject fluids through the string 104 into the formation 102 for the purpose of fracking. As shown, the surface system 116 includes a pumping device 118 in fluid communication with a tank 120. In some embodiments, the pumping device 118 can be used to extract fluid, such as hydrocarbons, from the formation 102, and store the extracted fluid in the tank 120. In other embodiments, the pumping device 118 can be configured to inject fluid from the tank 120 into the string 104 to introduce fluid into the formation 102, for example, to stimulate and/or fracture the formation 102.

One or more flow rate and/or pressure sensors 122, as shown, are disposed in fluid communication with the pumping device 118 and the string 104 for measurement of fluid characteristics. The sensors 122 may be positioned at any suitable location, such as proximate to (e.g., at the discharge output) or within the pumping device 118, at or near a wellhead, or at any other location along the string 104 and/or within the borehole 106.

A processing and/or control unit 124 is disposed in operable communication with the sensors 122, the pumping device 118, and/or components of the downhole assembly 108. The processing and/or control unit 124 is configured to, for example, receive, store, and/or transmit data generated from the sensors 122 and/or the pump 118, and includes processing components configured to analyze data from the pump 118 and the sensors 122, provide alerts to the pump 118 or other control unit and/or control operational parameters, and/or communicate with and/or control components of the downhole assembly 108. The processing and/or control unit 124 includes any number of suitable components, such as processors, memory, communication devices and power sources.

Typically, an intervention procedure (e.g., stimulation, water shutoff, fracturing, acidizing, non-acid mud removal treatments, etc.) is generated and performed after a drilling operation is completed. That is, typically, a drilling operation can be performed using a system such as that shown in FIG. 1 and then a wireline sensor and/or production string can be disposed downhole to determine a intervention procedure that is customized to the downhole characteristics, environments, formation properties, etc. However, such processes can be time consuming. Accordingly, improved mechanisms and processes for preparing intervention procedures may be desirable.

According to embodiments of the present disclosure, applications of rock matrix and reservoir properties derived from advanced cuttings evaluation and advanced gas analysis are employed to generate intervention procedures and/or completions designs. Such gas analysis can include mud-gas derived porosity, permeability indexes, volumetric fluid/gas saturation determinations, and/or other information and/or characteristics related to or associated with downhole formations. Using such data, in accordance with embodiments of the present disclosure, a customized reservoir matrix and fracture intervention procedure can be prepared. Such intervention procedures can include acidizing in sandstone, carbonate and geothermal wells; chemical injection, water shut-off, or other downhole procedures.

Embodiments of the present disclosure enable characterization of formation properties at one or more target zones (e.g., zones for intervention or stimulation) and enable zonal/stage intervention treatment that are designed specifically based on the formation properties (e.g., customized intervention procedures). Intervention, such as carbonate matrix stimulation, includes pumping fluids such as acids downhole through a string and use of diverters, as will be appreciated by those of skill in the art. Volumes and rates of treatment (e.g., acids, fluids, etc.) can be based on laboratory tests of cores under experimental or simulated conditions.

However, improved intervention procedures and designs can be used to reduce fluid injection volume, control placement of sections of a stimulation or intervention tool, and/or enable results directly and reliably. Embodiments provided herein employ single-trip formation characterization during a drilling operation, combining both mechanical and chemical analysis. Such single-trip characterization can enable minimized risks and enhance well productivity. For example, improved acid completion designs may be achieved through embodiments of the present disclosure.

In one non-limiting embodiment of the present disclosure, a stimulation acid design is derived through quantitative design principles that leverage drill cuttings analysis and quantitative fluids and gases approaches that can improve post-intervention production, increase predictability, and improve well economics. Matrix acidizing requires understanding of the formation mineralogy, permeability contrast, presence of natural fractures, hydrocarbon and/or fluid phase, and the proximity of water bearing zones. Acid concentration and recipe is based upon rock matrix mineralogy, specific acid solubility properties, and hydrocarbon content. Specific mineralogy information is important to prevent damage to a formation reservoir and/or flow rates that may occur as a result of acid re-precipitation reaction products.

Various factors associated with an acid used for injection and intervention (e.g., stimulation) may be considered and customized based on information obtained from embodiments of the present disclosure. For example, acid solubility is an indicator of acid effectiveness and acid formulation must be compatible with formation fluids. Further, information associated with reservoir permeability contrast, natural fractures, and geo-hazard can enable improved completion strategies and/or software modeling. Reservoir permeability contrast, natural fractures, geo-hazard information can influence the use of diverters or special isolation tools, as well as impact selected pumping rates, volumes, and stimulation fluid viscosity. Finally, for example, permeability parameters may play an important role in acid injection software modeling.

The above information that can be used for optimizing acid stimulation procedures may not be available in normal drilling and completion operations. For example, formation cores are rarely available, and, while highly desired, logistically extracting and analyzing formation cores can be difficult and time consuming (e.g., requiring lab analysis). Further, formation evaluation tools may require dedicated or specific borehole intervention to extract desired characteristics and/or properties. However, in accordance with embodiments of the present disclosure, drill cuttings and mud-gas data, which are readily available during such operations, may be employed to generate or design intervention procedures, such as acid stimulation.

The combination of drill-cuttings data and mud-gas data enables reservoir characterization and quantified mineralogy and elemental datasets for the determination of matrix, possible natural fractures and/or faults, as well as acid reactive diagenetic cements. The mud-gas datasets can provide porosity and permeability indices, as well as information regarding geological features, such as natural fractures and faults. Workflows in accordance with embodiments of the present disclosure include such reservoir characterization information for achieved desired (e.g., optimized) intervention procedure designs. Such customization can include stimulation fluid recipe, completion strategy, and treatment schedule. Advantageously, design of stimulation acid derived through quantitative design principles leveraging drill cuttings analysis and advanced gas analysis and drilling parameters can improve post-intervention production, increase predictability, and improve well economics.

Advanced gas analysis can be employed to identify the proximity of water to a borehole or borehole and provide information regarding potential breakthrough into water bearing zones. Such information can enable determination of an optimal treatment design, thus minimizing post treatment water production. The disclosed workflow of the present disclosure provides crucial information for intervention procedure designs, including, but not limited to acid recipe, completion strategy, and intervention schedule. In accordance with embodiments of the present disclosure, surface logging creates a detailed record of drilling parameters, measurement of fluids and gases, and of drill cuttings properties. Such drilling-related information can include, but is not limited to, lithology, mineralogy, and the presence of hydrocarbons and/or reactive formation gases and fluids. Analysis of these records (drilling-related information) can enable operators to better evaluate the formations, identify ways to combat borehole instability, optimize hole cleaning, prevent stuck pipe, improve drilling performance, and optimize the intervention design.

Figure 3:
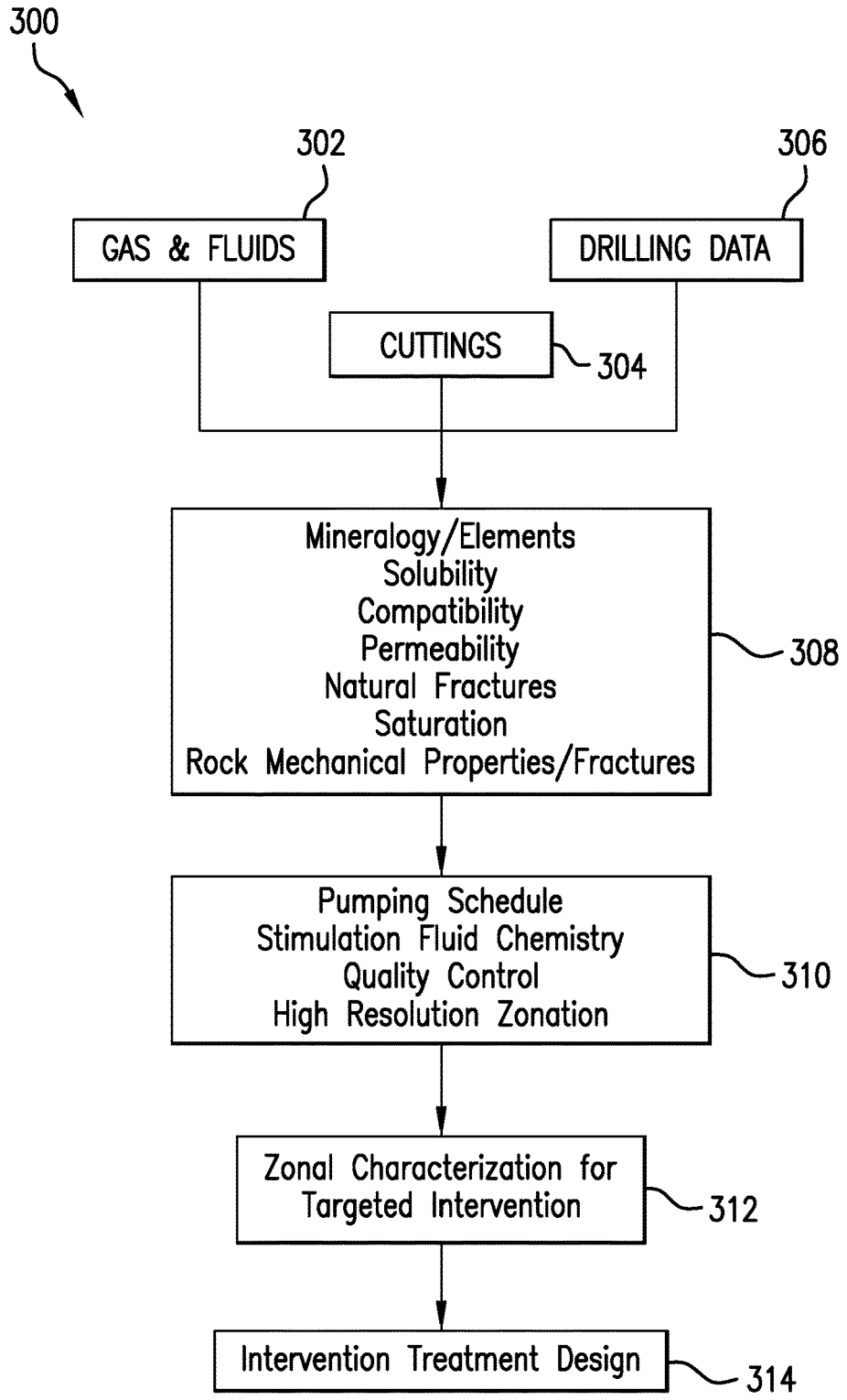
FIG. 3 is a schematic workflow for optimizing an intervention operation in accordance with an embodiment of the present disclosure.

Turning now to FIG. 3, a schematic illustration of a workflow 300 in accordance with an embodiment of the present disclosure is shown. The workflow 300 can be implemented within a system such as shown in FIG. 1, including processing performed with the control unit 40. The workflow 300 can be performed during a drilling operation that includes injecting mud into and through a drill string that is disposed within a borehole. The mud is cycled through the string, out of various ports and/or bits, and then back up an annulus of the borehole. During the drilling operation, various drilling-related data can be obtained.

For example, as shown in workflow 300, gas and fluid information 302, cuttings information 304, and drilling data 306 can all be obtained during a drilling operation. Such data and information 302, 304, 306 can be obtained through mud logging at the surface (collectively referred to herein as "mud-logging data"). The fluid information 302 can include mud-gas ratio analysis, gas shows, etc. The fluid information 302 can include or be used to determine volumetrics, permeability, saturation, porosity, and/or other indications associated with fluid dynamics and characteristics downhole. Cuttings information 304 can be obtained through x-ray diffraction, x-ray refraction, capillary suction testing, digital microscope analysis, etc. The cuttings information 304 can include or be used to determine minerology, element quantification, clay expandability, rock texture, and/or other indications associated with the formation being drilled. The drilling data 306 may be obtained by typical drilling monitoring observations, tools, and systems, and can include, rate of penetration, borehole size, mud weight, fluid type, etc.

The mud-logging data 302, 304, 306 can be input into a processing tool (e.g., a controller or control unit 40 shown in FIG. 1) to generate zone characterization 308. Zone characterization, as used herein, refers to characterization of reservoir and/or formation properties (e.g., as included from each of the mud-logging data 302, 304, 306) and identification of specific (e.g., target) zones for dividing up a borehole and formation into intervention zones. The zone characterization 308 can be for a section of borehole that will be subject to stimulation, which may further be divided into zones with specific treatment plans or procedures, based on the zone characterization 308. For example, as shown in FIG. 3, the zone characterization 308 includes mineralogy and elements of various sections of a borehole which can then be divided into specific zones for intervention. Other properties within the zone characterization 308 can include, without limitation, solubility of sections of a borehole, compatibility, permeability, natural fractures, saturation, rock mechanic properties and fractures, etc. Further, additional inputs to the zone characterization 308 can include, but is not limited to, finite element data sets, laboratory and/or core flow analysis.

The zone characterization 308 (incorporating the mud-logging data 302, 304, 306) is then processed by a controller or control unit to generate targeted zones 310. The generation of the targeted zones 310 includes, for example, a pumping schedule, stimulation fluid chemistry, quality control, and high resolution zonation. That is, a designation of zones to be stimulated is achieved within the targeted zones 310.

The targeted zones 310 are then used to generate treatment characterization 312. The treatment characterization 312 includes various factors and properties associated with the targeted zones 310. That is, each zone within the targeted zones 310 can be customized for a treatment plan within the treatment characterization 312.

With the targeted zones 310 and the treatment characterization 312, an intervention treatment design 314 is generated. Subsequently, an intervention operation in accordance with the stimulation treatment design may be performed downhole.

Accordingly, embodiments of the present disclosure use available information such as advanced gas analysis and drill cuttings analysis (e.g., mud-logging data) to determine a stimulation or intervention method, provide data for acid stimulation software modeling, advise on acid formulation to minimize potential damage by acid byproduct reaction, and/or provide or generate recommendations on treatment volumes, fluid viscosity, pumping rates, diverters application, specialized mechanical isolation tools, etc.

With traditional formation evaluation focus being on real-time logging-while-drilling and wire-line technology, a major source of readily available geological information is being overlooked. However, embodiments of the present disclosure incorporate such geological information to generate improved intervention procedures. Drill cuttings are available on almost every well and/or downhole exploration operation and in any environment, but are generally used for only the most basic stratigraphic correlations. By running more advanced analysis on this underutilized geological source material, in accordance with the present disclosure, it is now possible to increase subsurface knowledge in a capital-efficient manner. Data acquisition and analysis can be performed at the surface using a controller or control unit. Subsequently, intervention planning preparation (e.g., software, processes, etc.) will use the collected and analyzed information (e.g., mineralogy, porosity, permeability, etc.) to optimize an intervention program (e.g., acidizing/stimulation programs). The collected and analyzed data provides insight to stage or zone placement and specific intervention and/or stimulation design in each respective zone or stage along the borehole.

Such mud-logging data analysis can be used for intervention in carbonate and sandstone formations. Such optimization of intervention programs can include improved lateral interval zone designation and/or treatment stages based on permeability contrast, presence of natural fractures, and/or geohazards. Further, an intervention (e.g., stimulation) treatment schedule, pump rates, and/or acid formulation can vary based on permeability contrast, mineralogy, etc. and thus optimization can be achieved in accordance with embodiments of the present disclosure.

For example, through mud-logging data analysis, various locations of fractures or fractured formation can be identified, and such fractured areas can be designated as for a specific custom intervention treatment. Similarly, sections where no (or fewer) fractures exist can be identified for a different intervention treatment. From such information, viscose pills, diverting agents, etc. can be pumped into the fractured areas at high rates, while tight zones (e.g., low fracture density) can be stimulated with a reservoir appropriate acid or solvent/surfactant packages at low rates.

In another example, acid stimulation based on the mud-logging data analysis can be employed to determine an optimum formulation and/or treatment for the best wormhole propagation (carbonates). Additional acid formulation can be based on mineralogy information. For example, retarded sandstone acid is recommended for hydrogen fluoride (HF) sensitive formation. Further, hydrogen chloride (HCl) preflush can be programmed or planned for pumping in high calcium hyposulfite (CaSO2) content zones. Additional acid solubility can be performed on drill cuttings (during a drilling operation) to determine acid formulation.

Embodiments of the present disclosure are directed to innovative applications of rock matrix and reservoir properties derived from advanced cuttings evaluation (e.g., elemental, mineralogical, pyrolysis, source rock potential, etc.) and advanced gas analysis (e.g., mud gas derived porosity, permeability indexes, volumetric fluid/gas saturation determinations, gas isotopes, etc.) to optimize reservoir matrix and fracture stimulation (i.e., intervention operations), including acidizing in sandstone, carbonate, geothermal wells, chemical injection, and water shut-off. In accordance with embodiments described herein, characterization of rock properties (e.g., matrix and reservoir) of target zones for intervention operation are extracted. From this, an optimum zonal/stage intervention operation (e.g., stimulation treatment) can be generated and performed in an efficient manner. Further, intervention fluid designs (e.g., acid formulation) can be derived through quantitative design principles that leverages drill cuttings analysis and quantitative fluids and gases approaches (e.g., mud-gas ratio analysis) that can improve post-stimulation production, increase predictability of outcomes, and improve well economics.

Matrix acidizing requires understanding of mineralogy of a formation or region of interest that is located downhole, permeability contrast, presence of natural fractures, hydrocarbon and/or fluid phase, and the proximity of water bearing zones. Acid concentration and recipe is based upon rock matrix mineralogy, specific acid solubility properties, and hydrocarbon content. Specific mineralogy is important to prevent formation reservoir/flow damage occurring as a result of acid re-precipitation reaction products. Acid solubility is an indicator of acid effectiveness. Acid formulation must be compatible with formation fluids (e.g., hydrocarbons). Reservoir permeability contrast, natural fractures, geological hazards, etc. is essential for the best completion strategy and software modeling. Reservoir permeability contrast, natural fractures, geological hazards, etc. can dictate the use of diverters or special isolation tools, as well as pumping rates, volumes and stimulation fluid viscosity, etc.

The above information is not available most of the time, e.g., during typical operations and preparation and planning for intervention operations. Formation core is rarely available, and while highly desired, logistically it is quite difficult and time consuming to perform core analysis in the laboratory. Further, most formation evaluation tools are expensive, can require wellbore intervention, etc. In contrast, drill cuttings and mud-gas data are readily available from a drilling operation. The combination of these two reservoir characterization services provides quantified mineralogy and elemental datasets for the determination of matrix, possible natural fractures and/or faults, as well as acid reactive diagenetic cements. Mud-gas datasets can provide porosity and permeability indexes, as well as geological features including natural fracture sets and or faults.

The workflow 300, shown in FIG. 3, includes the crucial reservoir characterization information for an optimized intervention operation design/plan/program. Such information can enable optimized stimulation or intervention fluid recipe, completion strategy, and/or treatment schedule. Intervention fluid design can be derived through quantitative design principles leveraging drill cuttings analysis and advanced gas analysis and drilling parameters can improve post-stimulation production, increase predictability of outcomes, and improve well economics. Advanced gas analysis can identify the proximity of water and provide insight to a potential breakthrough into water bearing zones. Accordingly, this information can allow a determination of an optimized treatment design, thus minimizing post treatment water production. The workflow 300 provides crucial information to a production/stimulation engineer or digital program/application, including, but not limited to, acid recipe, completion strategy, and stimulation schedule.

Surface logging (e.g., mud-logging data obtained during a drilling operation) creates a detailed record of drilling parameters, measurement of fluids and gases, drill cuttings properties (e.g., lithology, mineralogy, and the presence of hydrocarbons), and reactive formation gases and fluids. Analysis of the mud-logging data helps operators better evaluate the formations, identify ways to combat wellbore instability, optimize hole cleaning, prevent stuck pipe, improve drilling performance, and optimize intervention operation designs. Evaluation of drilling cuttings employs a variety of geochemical analytic techniques to examine drilled cuttings and/or core samples at the site of the drilling operation, while still drilling, rather than later in a laboratory. Such evaluation techniques can include, but is not limited to, X-ray Fluorescence (XRF) to provide an elemental analysis of a sample, X-ray Diffraction (XRD) to identify crystalline minerals present in the formation, High Resolution Digital Microscopes to digitally document grain size, matrix mineralogy, and indication of diagenetic cement types, Pyrolysis to analyze the type and maturity of kerogen and Total Organic Carbon present in samples, mud-gas ratio analysis to enable near-real time reservoir characterization using gas ratio geochemistry data, identify fluid contacts, fluid composition, hydrocarbon volumetric index, saturation, and/or permeability.

In accordance with embodiments of the present disclosure, a customized intervention treatment program or design can be generated. Embodiments, as described above, are an integrated technology that combines pressure pumping matrix acidizing and surface logging services to generate optimized and/or custom intervention operation plans/programs.

Figure 4:
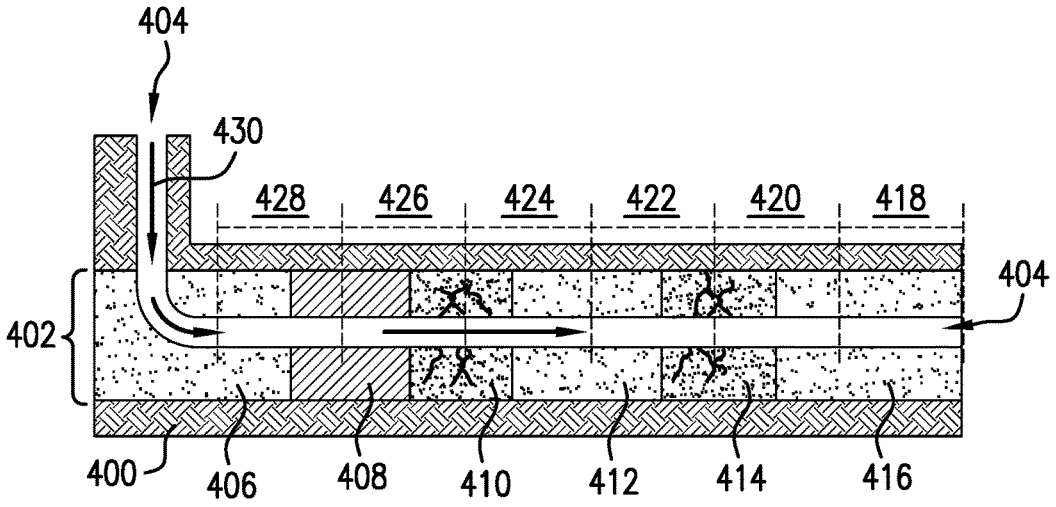
FIG. 4 is a schematic illustration of a downhole formation with various stages arranged along a borehole.

Turning now to FIG. 4, a schematic illustration of a formation 400 divided into various stages is shown. In FIG. 4, the formation 400 includes a region of interest 402, which as shown, is a lateral extension or structure within the formation 400. A lateral borehole 404 is shown drilled into and through at least a portion of the region of interest 402. The region of interest 402 can extend through and/or include different types of geological structures and/or have different characteristic zones. For example, as shown in FIG. 4, the region of interest 402 has a first tight zone 406, a water zone 408, a first fractured zone 410, a second tight zone 412, a second fractured zone 414, and a third tight zone 416.

Although the region of interest 402 is separated into various distinct zones, with each zone having different characteristics, a typical intervention program will divide the borehole 404 into a number of equal-length stages. For example, as shown in FIG. 4, a first stage 418 is shown at a lowest extent of the borehole 404. Uphole from the first stage 418 is a second stage 420, a third stage 422, a fourth stage 424, a fifth stage 426, and a sixth stage 428. Typically, as will be appreciated by those of skill in the art, the stages 418, 420, 422, 424, 426, 428 may be between 150 feet (45.72 meters) to 300 feet (91.44 meters) in length, depending on the particular intervention plan/program. An intervention fluid 430 is injected into the borehole 404 (or a string within the borehole 404) to perform an intervention operation (e.g., acid treatment, fracturing, etc.).

During an intervention operation, the intervention fluid 430 is pumped downhole to the first stage 418 to effect an intervention in the first stage 418. Upon completion of intervention of the first stage 418 (e.g., in accordance with an intervention schedule or plan), a diverter, plug, drop ball, or other element may be activated to stop intervention in the first stage 418 such that intervention begins in the second stage 420. The process is repeated to perform intervention at each of the stages 418, 420, 422, 424, 426, 428. In this way, the region of interest 402 can be treated in accordance with an intervention plan/program to achieve a desired result.

In one non-limiting example of an intervention operation performed with respect to the arrangement shown in FIG. 4, a stimulation treatment schedule, pump rate, and acid formulation may be constant for all stages. That is, characteristics of the intervention program may not be changed for each stage 418, 420, 422, 424, 426, 428. Further, because of the uniform length of the stages 418, 420, 422, 424, 426, 428, a zone of high permeability contrast (e.g., fractured zones 410, 414) and geohazard intervals (e.g., water zone 408) may be combined into a single stage or a stage may overlap various zones of the region of interest 402. As such, the intervention operation may not be effective as a custom intervention program. For example, in such an arrangement of stages 418, 420, 422, 424, 426, 428, acid may penetrate high permeable zones and leave a large portion of the region of interest 402 unstimulated.

Figure 5:
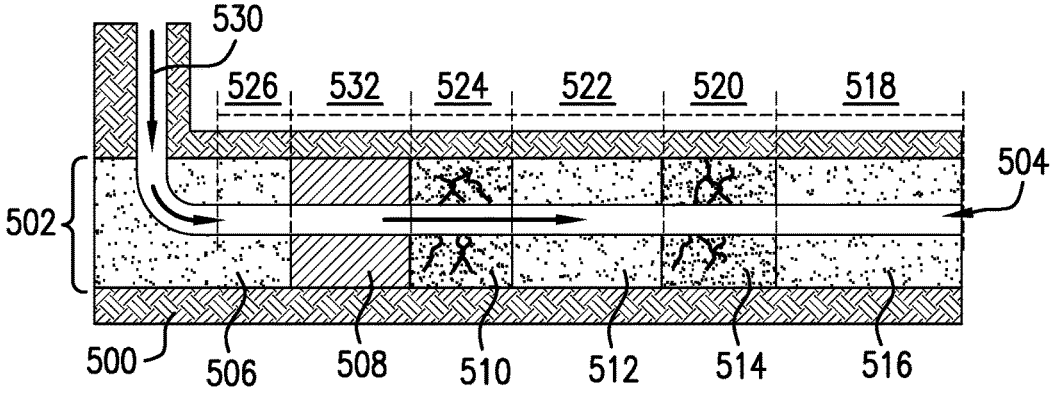
FIG. 5 is a schematic illustration of a downhole carbonate formation with various stages arranged along a borehole in accordance with an embodiment of the present disclosure.

Turning now to FIG. 5, a schematic illustration of a carbonate formation 500 divided into various stages in accordance with an embodiment of the present disclosure is shown. Similar to that shown in FIG. 4, the carbonate formation 500 includes a region of interest 502, which as shown, is a lateral extension or structure within the carbonate formation 500. A lateral borehole 504 is shown drilled into and through at least a portion of the region of interest 502. The region of interest 502 can extend through and/or include different types of geological structures and/or have different characteristic zones. For example, as shown in FIG. 5, the region of interest 502 has a first tight zone 506, a water zone 508, a first fractured zone 510, a second tight zone 512, a second fractured zone 514, and a third tight zone 516.

In contrast to that shown in FIG. 4, an intervention program generated in accordance with the present disclosure (e.g., based on mud-logging date) can customize the stage arrangement to the specific characteristics of the carbonate formation 500 and the region of interest 502. As such, even though the region of interest 502 is separated into various distinct zones, with each zone having different characteristics, a mud-logging based intervention program will divide the borehole 504 into a number of stages with each stage configured for a specific zone. For example, as shown in FIG. 5, a first stage 518 is shown at a lowest extent of the borehole 504 and spans a length of the third tight zone 516. Uphole from the first stage 518 is a second stage 520 that is shorter in length than the first stage 518 and spans a length of the second fractured zone 514. Uphole from the second stage 520 is a third stage 522 that spans a length of the second tight zone 512. Uphole from the third stage 522 is a fourth stage 524 that spans a length of the first fractured zone 510. As shown, the first zone 526 is uphole of the fourth stage 524 and is arranged about a portion of the first tight zone 506. Because of the improved intervention program generation based on the mud-logging date, the water zone 508 is avoided entirely, which is spanned by an inactive stage 532.

As will be appreciated by those of skill in the art, each of the stages 518, 520, 522, 524, 526, 532 is of different length or at least of customized length to match a zone that the specific stage will operate on. An intervention fluid 530 is injected into the borehole 504 (or a string within the borehole 504) to perform an intervention operation (e.g., acid treatment, fracturing, etc.) at each of the customized stages 518, 520, 522, 524, 526, with avoidance of the inactive stage 532. The intervention operation may be similar as that described above, working uphole from the first stage 518 to the fifth stage 526.

In the intervention operation of FIG. 5, in accordance with an embodiment of the present disclosure, the lateral interval of the region of interest 502 is separated into treatment stages based on permeability contrast, presence of natural fractures, geohazard zones, and/or other characteristics, with a length of the stage based on the characteristics to enable treatment of a desired configuration to be applied to the zone and not to zones where the treatment may not be as effective. Further, in addition to customized stage lengths, stimulation treatment schedules, pump rates, and/or acid formulations can be varied and/or customized based on various characteristics of the specific zones, including, but not limited to, permeability contrast, mineralogy, etc. In one non-limiting example of such intervention operation, viscose pills and diverting agents will be pumped into naturally fractured areas at high rates (e.g., second and fourth stages 520, 524), while basic acid or solvent formulations can be pumped into tight zones at lower rates (e.g., first, third, and fifth stages 518, 522, 526).

Acid treatment can be used to generate "wormholes" within a formation of interest. The acid is injected to enlarge pores in the formation to create flow channels (i.e., the "wormholes"). In accordance with embodiments of the present disclosure, acid stimulation using permeability contrast can be run to determine the optimum treatment for the best wormhole propagation. Further, additional acid solubility testing can be performed on drill cuttings to pick acid formulation. For example, the success of a carbonate matrix acid treatment can depend on the dissolution structure. As such, there exists an optimum rate to give the most effective treatment. Various factors can influence wormhole propagation, including but not limited to, (i) reaction kinetics (e.g., acid reactivity, temperature, etc.) which can be determined from drill cuttings, X-ray Fluorescence, X-ray Diffraction, etc. and (ii) rock properties (e.g., porosity and permeability) which can be determined from gas analysis, mud-gas ratio analysis, X-ray Fluorescence, X-ray Diffraction, etc. Using processes as described herein, damaged or low permeability regions/zones can be avoided or bypassed, and thus productivity and/or injectivity of the system can be improved.

Figure 6:
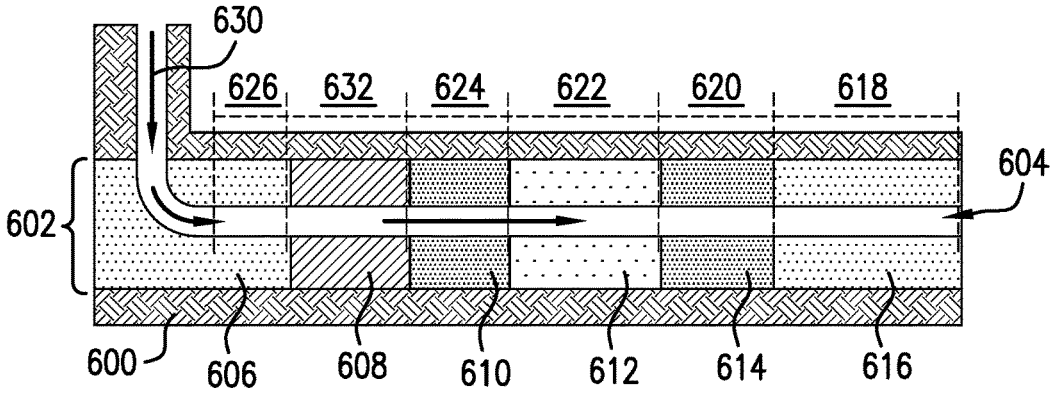
FIG. 6 is a schematic illustration of a downhole sandstone formation with various stages arranged along a borehole in accordance with an embodiment of the present disclosure.

Turning now to FIG. 6, a schematic illustration of a sandstone formation 600 divided into various stages in accordance with an embodiment of the present disclosure is shown. Similar to that shown in FIGS. 4-5, the sandstone formation 600 includes a region of interest 602, which as shown, is a lateral extension or structure within the sandstone formation 600. A lateral borehole 604 is shown drilled into and through at least a portion of the region of interest 602. The region of interest 602 can extend through and/or include different types of geological structures and/or have different characteristic zones. For example, as shown in FIG. 6, the region of interest 602 has a first clean sandstone zone 606, a water zone 608, a dirty sandstone zone 610, an HCl acid-sensitive zone 612, a fractured zone 614, and a second clean sandstone zone 516.

Similar to that shown in FIG. 5, and in contrast to that shown in FIG. 4, an intervention program generated in accordance with the present disclosure (e.g., based on mud-logging date) can customize the stage arrangement to the specific characteristics of the sandstone formation 600 and the region of interest 602. As such, even though the region of interest 602 is separated into various distinct zones, with each zone having different characteristics, a mud-logging based intervention program will divide the borehole 604 into a number of stages with each stage configured for a specific zone. For example, as shown in FIG. 6, a first stage 618 is shown at a lowest extent of the borehole 604 and spans a length of the second clean sandstone zone 516. Uphole from the first stage 618 is a second stage 620 that is shorter in length than the first stage 618 and spans a length of the fractured zone 614. Uphole from the second stage 620 is a third stage 622 that spans a length of the HCl acid-sensitive zone 612. Uphole from the third stage 622 is a fourth stage 624 that spans a length of the dirty sandstone zone 610. Uphole of the fourth stage 624 is an inactive stage 632, and then uphold of the inactive stage 632 is a fifth stage 626 that is arranged along a portion of the first clean sandstone zone 606. Because of the improved intervention program generation based on the mud-logging date, the water zone 608 is avoided entirely using the inactive stage 632.

As will be appreciated by those of skill in the art, each of the stages 618, 620, 622, 624, 626, 632 is of different length or at least of customized length to match a zone that the specific stage will operate upon. An intervention fluid 630 is injected into the borehole 604 (or a string within the borehole 604) to perform an intervention operation (e.g., acid treatment, fracturing, etc.) at each of the customized stages 618, 620, 622, 624, 626, with avoidance of the inactive stage 632. The intervention operation may be similar as that described above, working uphole from the first stage 618 to the fifth stage 626.

In the intervention operation of FIG. 6, in accordance with an embodiment of the present disclosure, the lateral interval of the region of interest 602 is separated into treatment stages based on permeability contrast, presence of natural fractures, mineralogy, and/or other characteristics, with a length of the stage based on the characteristics to enable treatment of a desired configuration to be applied to the zone and not to zones where the treatment may not be as effective. Further, in addition to customized stage lengths, stimulation treatment schedules, pump rates, and/or acid formulations can be varied and/or customized based on various characteristics of the specific zones, including, but not limited to, permeability contrast, mineralogy, etc. Formulation of the intervention fluid 630 can be based on mineralogy information. The criteria of selecting an acid system to stimulate sandstone formations depends on percentage of carbonate in the formation, type of clay in the formation, cementing material, reservoir temperature, etc.

For example, retarded sandstone acid is recommended for hydrogen fluoride (HF) sensitive formations because it can decrease the probability of forming precipitates of fluosilicates, fluoaluminates, or silica. Organic acid preflush will be pumped in high chlorite content zones. Chlorite is hydrogen chloride (HCl) sensitive clay mineral, and byproducts of the acid dissolution of chlorite clar are of concern because they can cause formation damage.

Advantageously, embodiments provided herein are directed to improved intervention operation planning and customization. By reducing geological uncertainty with an interdisciplinary approach (e.g., employing integrated reservoir characterization data sets) improved planning can be achieved. The workflow of embodiments of the present disclosure provide the integration of reservoir characterization inputs from various formation evaluation techniques, and brings a scientific approach into a borehole engineered stimulation design. Very often acidizing and stimulation design is simply based on offset or field-based approaches without site-specific data sets. Embodiments provided herein employ under-utilized borehole datasets (e.g., mud-logging, logging-while-drilling, wireline, sidewall/whole core data, etc.) to achieve a better determination of appropriate acids and site-specific optimal reservoir stimulation programs. The minimum datasets can be developed from mud-logging at the wellsite during a drilling operation. With the collection and appropriate software processing of mud-gas data, results will give indications of porosity, permeability, volumetrics, and saturations. This is combined with the drilled cuttings evaluation described above that develop the appropriate level of reservoir characterization. Any additional datasets that are collected can only increase the certainty of embodiments describe herein, and lower the geological risk in the operation.

Embodiment 1

A method for generating an intervention program for a downhole formation, the method comprising: collecting mud-logging data during a drilling operation, wherein the drilling operation forms a borehole through the formation; generating zone characterization of one or more zones along the borehole based on the collected mud-logging data; defining targeted zones of the one or more zones along the borehole; generating a treatment characterization for each targeted zone based on the collected mud-logging data; and generating an intervention treatment design based on the targeted zones and associated treatment characterizations.

Embodiment 2

The method any of the embodiments described herein, further comprising performing an intervention operation based on the intervention treatment design.

Embodiment 3

The method any of the embodiments described herein, wherein the intervention operation is one of an acidizing operation, a fracturing operation, or a non-acid mud removal treatment.

Embodiment 4

The method any of the embodiments described herein, wherein each zone within the formation has a unique geologic property and wherein the treatment characterization is based on the geologic property of the respective targeted zone.

Embodiment 5

The method any of the embodiments described herein, wherein the geologic property comprises as least one of porosity, permeability, density, rock property, and fluid property.

Embodiment 6

The method any of the embodiments described herein, wherein the zone characterization comprises at least one of information related to mineralogy, elements, solubility, compatibility, permeability, natural fractures, saturation, and rock mechanical properties.

Embodiment 7

The method any of the embodiments described herein, wherein the mud-logging data is obtained from at least one of gas and fluids generated during the drilling operation, cuttings from the drilling operation, and drilling data associated with the drilling operation.

Embodiment 8

The method any of the embodiments described herein, wherein the gas and fluids portion of the mud-logging data includes volumetrics indications, permeability indications, saturations indications, and porosity indications.

Embodiment 9

The method any of the embodiments described herein, wherein the cuttings portion the mud-logging data includes mineralogy, element quantification, clay expandability, and rock texture.

Embodiment 10

The method any of the embodiments described herein, wherein the drilling data portion of the mud-logging data includes rate of penetration, hole size, mud weight, and fluid type.

Embodiment 11

The method any of the embodiments described herein, wherein intervention treatment design comprises a plurality of stages, wherein each stage is associated with a targeted zone, the plurality of stages arranged to perform an intervention operation on the associated targeted zone.

Embodiment 12

The method any of the embodiments described herein, wherein each stage has a length equal to a length of the associated targeted zone.

Embodiment 13

The method any of the embodiments described herein, wherein each stage is designed based on the zone characterization of the associated targeted zone.

Embodiment 14

A system for generating an intervention program for a downhole formation, the system comprising: a drill string operable within the downhole formation to drill a borehole through the formation; and a control unit arranged to control the drill string and configured to: collect mud-logging data during a drilling operation; generate zone characterization of one or more zones along the borehole based on the collected mud-logging data; define targeted zones of the one or more zones along the borehole; generate a treatment characterization for each targeted zone based on the collected mud-logging data; and generate an intervention treatment design based on the targeted zones and associated treatment characterizations.

Embodiment 15

The system any of the embodiments described herein, wherein intervention treatment design comprises a plurality of stages, wherein each stage is associated with a targeted zone, the plurality of stages arranged to perform an intervention operation on the associated targeted zone.

Embodiment 16

The system any of the embodiments described herein, wherein each stage has a length equal to a length of the associated targeted zone.

Embodiment 17

The system any of the embodiments described herein, wherein each stage is designed based on the zone characterization of the associated targeted zone.

Embodiment 18

The system any of the embodiments described herein, wherein each zone within the formation has a unique geologic property and wherein the treatment characterization is based on the geologic property of the respective targeted zone.

Embodiment 19

The system any of the embodiments described herein, wherein the zone characterization comprises at least one of information related to mineralogy, elements, solubility, compatibility, permeability, natural fractures, saturation, and rock mechanical properties.

Embodiment 20

The system any of the embodiments described herein, wherein the mud-logging data is obtained from at least one of gas and fluids generated during the drilling operation, cuttings from the drilling operation, and drilling data associated with the drilling operation.

In support of the teachings herein, various analysis components may be used including a digital and/or an analog system. For example, controllers, computer processing systems, and/or geo-steering systems as provided herein and/or used with embodiments described herein may include digital and/or analog systems. The systems may have components such as processors, storage media, memory, inputs, outputs, communications links (e.g., wired, wireless, optical, or other), user interfaces, software programs, signal processors (e.g., digital or analog) and other such components (e.g., such as resistors, capacitors, inductors, and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (e.g., ROMs, RAMs), optical (e.g., CD-ROMs), or magnetic (e.g., disks, hard drives), or any other type that when executed causes a computer to implement the methods and/or processes described herein. These instructions may provide for equipment operation, control, data collection, analysis and other functions deemed relevant by a system designer, owner, user, or other such personnel, in addition to the functions described in this disclosure. Processed data, such as a result of an implemented method, may be transmitted as a signal via a processor output interface to a signal receiving device. The signal receiving device may be a display monitor or printer for presenting the result to a user. Alternatively or in addition, the signal receiving device may be memory or a storage medium. It will be appreciated that storing the result in memory or the storage medium may transform the memory or storage medium into a new state (i.e., containing the result) from a prior state (i.e., not containing the result). Further, in some embodiments, an alert signal may be transmitted from the processor to a user interface if the result exceeds a threshold value.

Furthermore, various other components may be included and called upon for providing for aspects of the teachings herein. For example, a sensor, transmitter, receiver, transceiver, antenna, controller, optical unit, electrical unit, and/or electromechanical unit may be included in support of the various aspects discussed herein or in support of other functions beyond this disclosure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The flow diagram(s) depicted herein is just an example. There may be many variations to this diagram or the steps (or operations) described therein without departing from the scope of the present disclosure. For instance, the steps may be performed in a differing order, or steps may be added, deleted or modified. All of these variations are considered a part of the present disclosure.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the present disclosure.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While embodiments described herein have been described with reference to various embodiments, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed as the best mode contemplated for carrying the described features, but that the present disclosure will include all embodiments falling within the scope of the appended claims.

Accordingly, embodiments of the present disclosure are not to be seen as limited by the foregoing description, but are only limited by the scope of the appended claims.

What is claimed is:

1. A method performed by a system for generating an intervention program for a downhole formation, the system having a drill string operable within the downhole formation to drill a borehole through the formation, and a control unit arranged to control the drill string and configure to perform method steps, the method comprising:

collecting mud-gas ratio data during a drilling operation, wherein the drilling operation forms a borehole through the formation;

generating zone characterization of one or more zones along the borehole based on the collected mud-gas ratio data;

defining targeted zones of the one or more zones along the borehole;

generating a treatment characterization for each targeted zone based on the collected mud-gas ratio data; and generating an intervention treatment design based on the targeted zones and associated treatment characterizations.

2. The method of claim 1, further comprising performing an intervention operation based on the intervention treatment design.

3. The method of claim 2, wherein the intervention operation is one of an acidizing operation, a fracturing operation, or a non-acid mud removal treatment.

4. The method of claim 1, wherein each zone within the formation has a unique geologic property and wherein the treatment characterization is based on the geologic property of the respective targeted zone.

5. The method of claim 4, wherein the geologic property comprises as least one of porosity, permeability, density, rock property, and fluid property.

6. The method of claim 1, wherein the zone characterization comprises at least one of information related to mineralogy, elements, solubility, compatibility, permeability, natural fractures, saturation, and rock mechanical properties.

7. The method of claim 1, wherein the mud-gas ratio data is obtained from at least one of gas and fluids generated during the drilling operation, cuttings from the drilling operation, and drilling data associated with the drilling operation.

8. The method of claim 7, wherein the gas and fluids portion of the mud-gas ratio data includes volumetrics indications, permeability indications, saturations indications, and porosity indications.

9. The method of claim 7, wherein the cuttings portion of the mud-gas ratio data includes mineralogy, element quantification, clay expandability, and rock texture.

10. The method of claim 7, wherein the drilling data portion of the mud-gas ratio data includes rate of penetration, hole size, mud weight, and fluid type.

11. The method of claim 1, wherein intervention treatment design comprises a plurality of stages, wherein each stage is associated with a targeted zone, the plurality of stages arranged to perform an intervention operation on the associated targeted zone.

12. The method of claim 10, wherein each stage has a length equal to a length of the associated targeted zone.

13. The method of claim 10, wherein each stage is designed based on the zone characterization of the associated targeted zone.

14. A system for generating an intervention program for a downhole formation, the system comprising:

a drill string operable within the downhole formation to drill a borehole through the formation; and a control unit arranged to control the drill string and configured to:

collect mud-gas ratio data during a drilling operation;

generate zone characterization of one or more zones along the borehole based on the collected mud-gas ratio data;

define targeted zones of the one or more zones along the borehole;

generate a treatment characterization for each targeted zone based on the collected mud-gas ratio data; and generate an intervention treatment design based on the targeted zones and associated treatment characterizations.

15. The system of claim 14, wherein intervention treatment design comprises a plurality of stages, wherein each stage is associated with a targeted zone, the plurality of stages arranged to perform an intervention operation on the associated targeted zone.

16. The system of claim 15, wherein each stage has a length equal to a length of the associated targeted zone.

17. The system of claim 15, wherein each stage is designed based on the zone characterization of the associated targeted zone.

18. The system of claim 14, wherein each zone within the formation has a unique geologic property and wherein the treatment characterization is based on the geologic property of the respective targeted zone.

19. The system of claim 14, wherein the zone characterization comprises at least one of information related to mineralogy, elements, solubility, compatibility, permeability, natural fractures, saturation, and rock mechanical properties.

20. The system of claim 14, wherein the mud-gas ratio data is obtained from at least one of gas and fluids generated during the drilling operation, cuttings from the drilling operation, and drilling data associated with the drilling operation.

* * * * *